US011506220B2

(12) United States Patent
Gebert

(10) Patent No.: US 11,506,220 B2
(45) Date of Patent: Nov. 22, 2022

(54) FAN WHEEL WITH THREE DIMENSIONALLY CURVED IMPELLER BLADES

(71) Applicant: ebm-papst Mulfingen GmbH & Co. KG, Mulfingen (DE)

(72) Inventor: Daniel Gebert, Öhringen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/332,345

(22) Filed: May 27, 2021

(65) Prior Publication Data

US 2021/0372424 A1 Dec. 2, 2021

(30) Foreign Application Priority Data

May 28, 2020 (DE) ..... 10 2020 114 387.7

(51) Int. Cl.
*F04D 29/34* (2006.01)
*F04D 29/30* (2006.01)
(Continued)

(52) U.S. Cl.
CPC ..... *F04D 29/281* (2013.01)

(58) Field of Classification Search
CPC ..... F04D 29/329; F04D 29/34; F04D 29/30; F04D 29/281; F04D 29/526; F04D 29/162; F04D 29/167; F04D 19/002
See application file for complete search history.

(56) References Cited

U.S. PATENT DOCUMENTS 10,550,854 B2 * 2/2020 Lörcher ..... F04D 29/66
2010/0202886 A1 * 8/2010 Iwata ..... F04D 29/282 416/182

(Continued)

FOREIGN PATENT DOCUMENTS

DE 102017114679 A1 1/2019
EP 2275689 A1 1/2011

(Continued)

OTHER PUBLICATIONS

European Search Report dated Oct. 14, 2021 in corresponding European Application No. EP21172988.4.

*Primary Examiner* — Long T Tran
(74) *Attorney, Agent, or Firm* — Harness, Dickey & Pierce, P.L.C.

(57) ABSTRACT

A fan wheel (1) has a bottom disc (4), a cover disc (3) and impeller blades (2) arranged around a rotation axis (RA) of the fan wheel (1). The blades, in each case, extend over a blade length from a blade leading edge (5) to a blade trailing edge (6). The impeller blades (2) are divided into a front section (10), rear section (12) and transition section (11). The front section (10), extends proceeding from the blade leading edge (5) in the direction of the blade trailing edge (6). The rear section (12) extends proceeding from the blade trailing edge (6), in the direction of the blade leading edge (5). The transition section (11) forms a transition between the front section (10) and the rear section (12). The impeller blades (2) are formed with opposite curvature in the course from the bottom disc (4) to the cover disc (3) in the front section (10) and the rear section (12).

13 Claims, 2 Drawing Sheets

(51) Int. Cl.
*F04D 19/00* (2006.01)
*F04D 29/28* (2006.01)

(56) References Cited

U.S. PATENT DOCUMENTS

| | | | | |
|---|---|---|---|---|
| 2010/0329871 | A1* | 12/2010 | Cahill | F04D 29/626 416/187 |
| 2012/0045338 | A1* | 2/2012 | Tadokoro | F04D 29/30 416/196 R |
| 2014/0062232 | A1 | 3/2014 | Cocks et al. | |
| 2015/0316073 | A1* | 11/2015 | Lörcher | F04D 29/30 425/468 |

FOREIGN PATENT DOCUMENTS

| | | | |
|---|---|---|---|
| EP | 2910793 | A1 | 8/2015 |
| EP | 2921711 | A1 | 9/2015 |

* cited by examiner

FAN WHEEL WITH THREE DIMENSIONALLY CURVED IMPELLER BLADES

CROSS-REFERENCE TO RELATED APPLICATION

This application claims priority to German Patent Application No. 102020114387.7 filed May 28, 2020. The entire disclosure of the above application is incorporated herein by reference.

FIELD

The disclosure relates to a fan wheel with three-dimensionally curved impeller blades.

BACKGROUND

The prior art illustrates fan wheels with impeller blades that are curved forward or curved backward with respect to the direction of rotation. Also, it illustrates impeller blades that are curved with respect to the rotation axis of the fan wheel. See, for example, published document DE 10 2017 114 679 A1.

The fan wheel presented in the present case is used in volume flow-conducting elements, for example, so-called air handling units, in the ventilation field and air conditioning technology. Here, the stability and, in particular, the rotational speed stability play a decisive role. A critical point is the material stress at the transition between the respective impeller blades of the fan wheel and the bottom disc and/or the cover disc. To ensure the rotational speed stability, spokes are frequently provided in the transition region in the prior art.

The underlying aim of the disclosure is to further optimize the previous solutions of the fan wheels with regard to their efficiency, noise generation and the possibility of even higher rotational speeds.

SUMMARY

This aim is achieved by a fan wheel with a bottom disc, a cover disc and impeller blades arranged around a rotation axis of the fan wheel. The blades in each case extend over a blade length from a blade leading edge to a blade trailing edge. The impeller blades are divided into a front section, rear section and transition section. The front section extends, proceeding from the blade leading edge, in the direction of the blade trailing edge. The rear section extends, proceeding from the blade trailing edge, in the direction of the blade leading edge. The transition section forms a transition between the front section and the rear section. The impeller blades are formed with opposite curvature in the course from the bottom disc to the cover disc in the front section and the rear section.

According to the disclosure, a fan wheel has a bottom disc, a cover disc and impeller blades arranged around a rotation axis of the fan wheel. The blades in each case extend over a blade length from a blade leading edge to a blade trailing edge. The impeller blades are divided into a front section, a rear section and a transition section. The front section extends, proceeding from the blade leading edge, in the direction of the blade trailing edge. The rear section extends, proceeding from the blade trailing edge, in the direction of the blade leading edge. The transition section forms a transition between the front section and the rear section. The impeller blades, in the front section and the rear section, are formed with opposite curvature in the course from the bottom disc to the cover disc.

In a variant embodiment, the fan wheel has impeller blades formed with opposite curvature, in particular, three-dimensional curvature, in the front section and the rear section with respect to a shortest path between the bottom disc and the cover disc.

In an additional embodiment, the impeller blades are formed with an arc-shaped curvature. The course of the arc preferably has a constant or substantially constant arc radius.

In another advantageous embodiment of the fan wheel, the front section extends over at least 5%, preferably over 10-40% of the blade length. Likewise, it is advantageous if the rear section extends over at least 5%, preferably over 10-40% of the blade length.

In the fan wheel, the transition section connects the front section and the rear section. In particular, the transition has a continuous course along the blade length. The change of the curvature of the front section and of the rear section, i.e., the opposite curvature in the front section and in the rear section, is preferably implemented in the transition section by a course of identical shape.

In a fluidically advantageous embodiment example of the fan wheel, the front section is formed with a curvature toward the rotation axis and the rear section is formed with a curvature away from the rotation axis.

In the fan wheel, the bottom disc includes a hub where the impeller blades are attached or formed. The hub forms an interface to the motor and is either formed by the bottom disc as a single piece or is arranged thereon.

Furthermore, the fan wheel comprises the cover disc which, at least partially, in particular completely, covers axial blade front edges of the impeller blades. The cover disc then forms the axial suction opening of the fan wheel.

In a development of the fan wheel, the impeller blades end on the bottom disc at a distance (R) radially inward with respect to an outer radius of the bottom disc. The distance determines at least 5% of a total diameter (D) of the bottom disc. Thus, $R/D>0.05$. More preferred the range is between 5-25% and, more preferably, between 10-15%. The impeller blades therefore end clearly set back with respect to the radial outer margin of the bottom disc. Thus, the flow is in contact with the bottom disc over a longer distance.

Furthermore, in an embodiment example, the fan wheel bottom disc has an elliptical cross section on its radial outer margin section. Thus, its radial outer margin extends parallel or substantially parallel to the rotation axis.

In an embodiment example, the cover disc has a radially internal section that determines an axial extent parallel to the rotation axis. The impeller blades are not in contact with the axially extending section. The cover disc then extends further, in particular, in the radial direction and extends over the impeller blades in contact therewith.

Furthermore, in another advantageous embodiment of the cover disc, the cover disc, when viewed in a lateral cross section, has an at least partially curved course and determines an axial change of direction on its radial outer margin section.

In the fan wheel, in an advantageous embodiment, the impeller blades extend from the blade leading edge to the blade trailing edge in each case radially outward and around the rotation axis. The impeller blades are therefore curved forward or curved backward with respect to the direction of rotation.

The fan wheel according to the disclosure is formed, in particular, as a radial impeller or a diagonal impeller. Preferably the fan wheel is made of a single piece, in particular of plastic. However, the use of multi-piece impellers made of metal, in particular of sheet metal, is also possible.

Further areas of applicability will become apparent from the description provided herein. The description and specific examples in this summary are intended for purposes of illustration only and are not intended to limit the scope of the present disclosure.

DRAWINGS

Other advantageous developments of the disclosure are in the subclaims and/or depicted in greater detail below together with the description of the preferred embodiment of the disclosure with reference to the figures. In the drawing:

DETAILED DESCRIPTION

Figure 1:
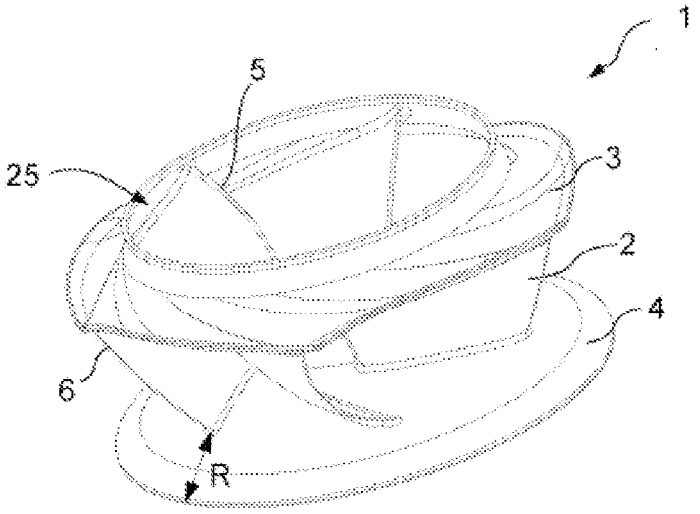
FIG. 1 is a perspective view of a fan wheel in an embodiment as a radial impeller.
Figure 2:
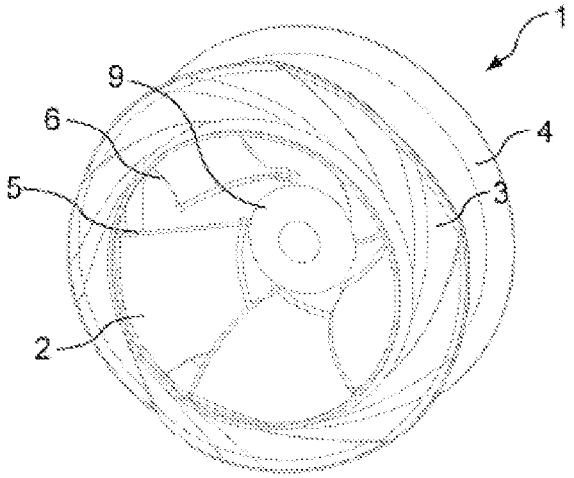
FIG. 2 is a perspective view of the fan wheel of FIG. 1.

FIGS. 1 and 2 show perspective views of the fan wheel 1 in an embodiment as a single-piece radial impeller with a bottom disc 4, a cover disc 3 determining the suction opening 25, and impeller blades 2. The impeller blades have a backward curvature arranged between the bottom disc 4 and the cover disc 3 in a blade ring around the rotation axis RA.

The impeller blades 2 extend from a hub 9, formed by the bottom disc 4, from their inlet-side blade leading edge 5, in peripheral direction, and radially outward to their outlet-side blade trailing edge 6. The cover disc 3 extends completely over the axial front edges of the impeller blades 2. During operation, the flow is suctioned axially through the suction opening 25 and expelled radially through the channels formed between the impeller blades 2.

Figure 3:
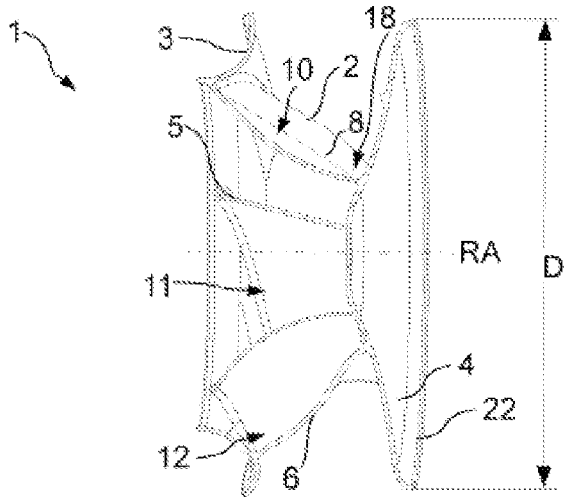
FIG. 3 is a cross-sectional perspective view of the fan wheel of FIG. 1.
Figure 4:
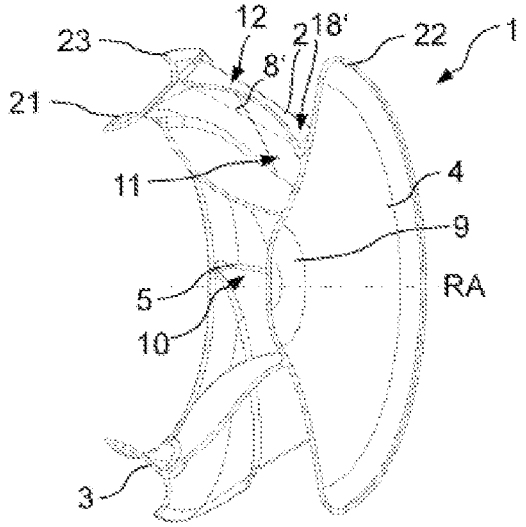
FIG. 4 is a second cross-sectional perspective view of the fan wheel from FIG. 1.

In reference to FIGS. 3 and 4, the geometry of the impeller blades 2 can clearly be seen. Over the respective blade length, from the blade leading edge 5 to the blade trailing edge 6, each of the impeller blades has three sections. They include the front section 10, rear section 12 and transition section 11. The front section 10 extends, proceeding from the blade leading edge 5, in the direction of the blade trailing edge 6. The rear section 12 extends, proceeding from the blade trailing edge 6, in the direction of the blade leading edge 5. The transition section 11 forms the transition between the front section 10 and the rear section 12.

The front section 10 can easily be seen in the cross section in FIG. 3. The rear section can easily be seen in the cross section in FIG. 4. In the front section 10 and in the rear section 12, the impeller blades 2 are formed with an arc-shaped three-dimensional curvature with respect to the rotation axis RA in the course form the bottom disc 4 to the cover disc 3. In each case, the shortest path between bottom disc 4 and cover disc 3 is indicated by the lines 8, 8'. Thus, the curvature can be seen. Here, the arc-shaped curvature occurs so that the impeller blades 2 are formed with opposite three-dimensional curvature in the front section 10 and the rear section 12. In the embodiment shown, the curvature occurs in the front section 10 toward the rotation axis (see FIG. 3) and in the rear section 12 away from the rotation axis (see FIG. 4). However, the curvature toward and away from the rotation axis RA can just as well occur reversed.

The impeller blades 2 transition both into the bottom disc 4 and also into the cover disc 3. In each case, the transition is at an angle with respect to the rotation axis. Together with the bottom disc 4, the impeller blades 2 form, in lateral cross section, in each case V-shaped connection regions 18, 18' in the front section 10 and rear section 12. The opening angle between the respective impeller blades 2 and the bottom disc 4 of the connection region 18' in the rear section 12 is clearly smaller than that of the connection region 18 in the front section 10.

The front section 10 and the rear section 12 each extend over approximately 30% of the entire blade length. The transition section 11 that lies inbetween the two determines the rest. Here, the transition section 11 has a continuous course along the blade length. Thus, the change in direction of the curvature of the impeller blades 2 from the front section 10 to the rear section 12, along the blade length, occurs uniformly over the entire axial height of the impeller blades 2 without discontinuity.

In reference to FIGS. 1 and 3, it can clearly be seen that the impeller blades 2 are arranged or end radially set back with respect to the outer radius, i.e., the outermost edge of the bottom disc 4. FIG. 1 shows, in this regard, the distance R between the blade trailing edge 6 and the outer radius of the bottom disc 4. In relation to the maximum total diameter D of the bottom disk, the distance R is established so that the ratio R/D=0.13.

In addition, both the cover disc 3 and the bottom disc 4 have a special shape. The cover disc 3 includes, when viewed from radially inward to radially outward, first the section 21, that which extends axially parallel to the rotation axis RA, and determines the suction opening 25. Next, when viewed in lateral cross section, there is a course with arc-shaped curvature covering the impeller blades 2, which, in the radial outer margin section 23 transitions like a winglet again into the axial direction parallel to the rotation axis RA. Thus, the cover disc 3, over its radial extent, performs a complete axial change in direction. The outer margin section 23 is adjacent to the impeller blades 2, as can be seen in FIG. 4.

The bottom disc 4, on its radial outer margin section 22, has an elliptical cross section and transitions from a radially outward extent into an axial extent. Thus, the radial outer margin of the bottom disc 4 extends parallel or substantially parallel to the rotation axis RA.

The disclosure is not limited in its embodiment to the aforementioned embodiment example. Instead the variants which are also described can correspondingly be applied to the embodiment according to the figures, for example, the opposite curvature of the impeller blades in the rear section adjoining the blade trailing edge toward the rotation axis and in the front section adjoining the blade leading edge away from the rotation axis. Alternative bottom disc and/or cover disc forms can also be used.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fan wheel with a bottom disc, a cover disc and impeller blades arranged around a rotation axis of the fan wheel, the blades in each case extend radially from the axis of rotation toward the outer circumference of the fan wheel over a blade length from a blade leading edge to a blade trailing edge:

the impeller blades are divided into a front section, rear section and transition section, the front section extends in a radial direction toward the outer circumference of the fan wheel, proceeding from the blade leading edge, in the direction toward the blade trailing edge, the rear section extends, proceeding from the blade trailing edge, in a radial direction toward the rotation axis of the fan wheel toward the blade leading edge, and the transition section extends radially toward the front section and toward the rear section to form a transition between the front section and the rear section; and wherein the impeller blades are formed with opposite curvature along an axial course from the bottom disc to the cover disc in the front section and the rear section with respect to a shortest path between the bottom disc and the cover disc; and the front section is formed with a curvature toward the rotation axis and the rear section is formed with a curvature away from the rotation axis.

2. The fan wheel according to claim 1, wherein the impeller blades are formed with an arc-shaped curvature.

3. The fan wheel according to claim 1, wherein the front section extends over at least 5%, in particular over 10-40% of the blade length.

4. The fan wheel according to claim 1, wherein the rear section extends over at least 5%, in particular, over 10-40% of the blade length.

5. The fan wheel according to claim 1, wherein the transition section has a continuous course along the blade length.

6. The fan wheel according to claim 1, wherein the bottom disc includes a hub of the fan wheel, that forms an interface to a motor and that includes the impeller blades.

7. The fan wheel according to claim 1, wherein the cover disc at least partially, in particular completely, covers axial blade front edges of the impeller blades.

8. The fan wheel according to claim 1, wherein the impeller blades end on the bottom disc at a distance radially inward with respect to an outer radius of the bottom disc, the distance determines at least 5% of a total diameter (D) of the bottom disc, in particular 5-25% and preferably 10-15%, so that $R/D>0.05$, in particular $0.05 \leq R/D \leq 0.25$ and preferably $0.10 \leq R/D \leq 0.15$.

9. The fan wheel according to claim 1, wherein the bottom disc on its radial outer margin section has an elliptical cross section, so that its radial outer margin extends parallel or substantially parallel to the rotation axis.

10. The fan wheel according to claim 1, wherein the cover disc further comprises a radially internal section that has an axial extent parallel or substantially parallel to the rotation axis.

11. The fan wheel according to claim 1, where the cover disc, when viewed in a lateral cross section, has a curved course, and, on its radial outer margin section, it determines an axial change in direction.

12. The fan wheel according to claim 1, where the impeller blades extend from the blade leading edge to the blade trailing edge in each case radially outward and around the rotation axis.

13. The fan wheel according to claim 1, wherein it is a single-piece radial impeller or diagonal impeller.

* * * * *